US009238787B2

(12) United States Patent
Carlson et al.

(10) Patent No.: US 9,238,787 B2
(45) Date of Patent: Jan. 19, 2016

(54) TEXTILE CLEANING COMPOSITION COMPRISING A SUPERCRITICAL NOBLE GAS

(71) Applicants: William B. Carlson, Seattle, WA (US); Gregory D. Phelan, Cortland, NY (US); Philip A. Sullivan, Seattle, WA (US)

(72) Inventors: William B. Carlson, Seattle, WA (US); Gregory D. Phelan, Cortland, NY (US); Philip A. Sullivan, Seattle, WA (US)

(73) Assignee: EMPIRE TECHNOLOGY DEVELOPMENT LLC, Wilmington, DE (US)

( * ) Notice: Subject to any disclaimer, the term of this patent is extended or adjusted under 35 U.S.C. 154(b) by 149 days.

(21) Appl. No.: 13/974,972

(22) Filed: Aug. 23, 2013

(65) Prior Publication Data

US 2013/0345105 A1 Dec. 26, 2013

Related U.S. Application Data

(62) Division of application No. 13/002,263, filed as application No. PCT/US2010/044757 on Aug. 6, 2010, now Pat. No. 8,551,257.

(51) Int. Cl.

| | |
|---|---|
| ***C11D 3/395*** | (2006.01) |
| ***C11D 7/50*** | (2006.01) |
| ***C11D 9/20*** | (2006.01) |
| ***C11D 3/02*** | (2006.01) |
| ***B08B 7/00*** | (2006.01) |
| ***D06F 43/00*** | (2006.01) |
| ***D06F 43/08*** | (2006.01) |

(52) U.S. Cl.

CPC ..... *C11D 3/02* (2013.01); *B08B 7/0021* (2013.01); *D06F 43/007* (2013.01); *D06F 43/081* (2013.01)

(58) Field of Classification Search

CPC ..... C11D 3/395; C11D 11/0017; C11D 11/0005; C11D 7/50; C11D 3/001; C11D 9/20

See application file for complete search history.

(56) References Cited

U.S. PATENT DOCUMENTS

| | | | | |
|---|---|---|---|---|
| 5,013,366 | A | 5/1991 | Jackson et al. | |
| 5,370,742 | A | 12/1994 | Mitchell et al. | |
| 6,057,283 | A | 5/2000 | Oftring et al. | |
| 6,857,437 | B2 | 2/2005 | Fury et al. | |
| 2003/0084916 | A1 * | 5/2003 | Gaaloul et al. | 134/1 |
| 2004/0072706 | A1 | 4/2004 | Arena-Foster et al. | |
| 2004/0134515 | A1 | 7/2004 | Castrucci | |
| 2004/0198622 | A1 | 10/2004 | Korzenski et al. | |
| 2004/0224865 | A1 | 11/2004 | Roeder et al. | |
| 2004/0255978 | A1 | 12/2004 | Fury et al. | |
| 2004/0266635 | A1 | 12/2004 | Korzenski et al. | |
| 2005/0028927 | A1 | 2/2005 | Basceri et al. | |
| 2005/0167841 | A1 | 8/2005 | Papa Rao et al. | |
| 2005/0260107 | A1 | 11/2005 | Jackson et al. | |
| 2006/0081273 | A1 | 4/2006 | McDermott et al. | |
| 2007/0149429 | A9 * | 6/2007 | Roeder et al. | 510/175 |
| 2007/0240740 | A1 | 10/2007 | McDermott | |
| 2010/0016205 | A1 * | 1/2010 | Schwab | 510/244 |
| 2010/0043823 | A1 | 2/2010 | Lee | |

FOREIGN PATENT DOCUMENTS

| | | | |
|---|---|---|---|
| CN | 1642665 | A | 7/2005 |
| CN | 1741863 | A | 3/2006 |
| CN | 101190438 | A | 6/2008 |
| DE | 19903243 | A1 | 8/2000 |
| EP | 1 844 850 | A1 | 10/2007 |
| JP | 03-123604 | A | 5/1991 |
| JP | 2003-209088 | A | 7/2003 |
| JP | 2007-524228 | A | 8/2007 |
| RU | 2223654 | C1 | 2/2004 |
| WO | 90/06189 | A1 | 6/1990 |
| WO | 90/6189 | A1 | 6/1990 |
| WO | 03/057377 | A1 | 7/2003 |
| WO | 03/082486 | A1 | 10/2003 |
| WO | 2004/114376 | A2 | 12/2004 |
| WO | 2005/003273 | * | 1/2005 |
| WO | 2005/003273 | A1 | 1/2005 |

OTHER PUBLICATIONS

Henderson, M. et al "Phase diagram and pV isotherms of argon" Journal of Chemical Physics (1969), 51(12), 5420-9.

Ancsin, J. "Phase changes in argon" Metrologia (1973), 9(4), 147-54.

Saija, Franz et al "High-pressure phase diagram of the exp-6 model: The case of Xe" Physical Review B: Condensed Matter and Materials Physics (2005), 72(2), 024113/1-024113/10.

Prager, M. et al "Methane rotation and the phase diagram of methane/xenon" Journal of Chemical Physics (1993), 99(3), 2052-8.

(Continued)

*Primary Examiner* — Charles Boyer

(74) *Attorney, Agent, or Firm* — Maschoff Brennan

(57) ABSTRACT

A cleaning system can include a noble gas, and one or more vessels configured to convert the noble gas into a supercritical fluid, and/or receive and clean an article of manufacture with the noble gas in the supercritical fluid state. A cleaning process can include converting a noble gas into a supercritical fluid state; and cleaning an article of manufacture with the noble gas in the supercritical fluid state so as to remove one or more contaminants from the article of manufacture. A cleaning composition can include a noble gas in a supercritical fluid state, and a textile article of manufacture having one or more contaminants located in the supercritical noble gas.

20 Claims, 4 Drawing Sheets

(56) References Cited

OTHER PUBLICATIONS

Kim, Sunwook, et al "Phase behaviors and fractionation of polymer solutions in supercritical carbon dioxide" Journal of Supercritical Fluids (1998), 13(1-3), 99-106.

Goldfarb, Dario L., et al "Dielectric and volumetric properties of supercritical carbon dioxide (1) + methanol(2) mixtures at 323.15 K" Fluid Phase Equilibria (1999), 158-160 1011-1019.

Wang, Joanna Shaofen et al "Nuclear Laundry Using Supercritical Fluid Solutions" Industrial & Engineering Chemistry Research (2004), 43(7), 1580-1585.

Lazzaroni, M. J., et al "High-pressure vapor—liquid equilibria of argon + carbon dioxide + 2-propanol" J. of Supercritical Fluids (2006), 37, 135-141.

Luhring, P. et al "Gas solubilities (hydrogen, helium, nitrogen, carbon monoxide, oxygen, argon, carbon dioxide) in organic liquids at 293.2 K" J. Chem. Eng. Data 34 (1989) 250.

Liang, S. et al "Extraction of petroleum hydrocarbons from soil using supercritical argon" Analytical Chemistry (1998), 70(3), 616-622.

Sarashina, E., et al., "The P-V-T-X relation for the carbon dioxide-argon system," J. Chem. Eng. Jpn. (1971), vol. 4, pp. 379-381.

Wu, C., "Non-Toxic Dry Cleaning Alternatives," accessed at http://www.ecomall.com/greenshopping/dryclea2.htm, accessed on Apr. 11, 2012, pp. 7.

International Search Report dated Oct. 29, 2010 in application No. PCT/US20101044757.

Chinese Search Report dated Apr. 28, 2014 in application No. 201080068495.1.

Chinese Office Action dated Apr. 28 ,2014 in application No. 201080068495.1.

Chinese Search Report dated Jan. 4, 2015 in application No. 201080068495.1.

* cited by examiner

TEXTILE CLEANING COMPOSITION COMPRISING A SUPERCRITICAL NOBLE GAS

CROSS-REFERENCE TO RELATED APPLICATIONS

This patent application is a divisional of U.S. patent application Ser. No. 13/002,263, filed on Dec. 30, 2010, now Pat. No. 8,551,257, which is the national phase of Patent Cooperation Treaty International Patent Application No. PCT/US2010/044757, filed Aug. 6, 2010. The foregoing patent applications are incorporated herein by reference.

BACKGROUND

Cleaning compositions that are used in cleaning laundry, such as highly toxic detergent compositions and halogenated solvents, can be problematic for the environment and can be costly to process into a disposable format. Industrial cleaners may have the same environmental concerns due to the level of toxic ingredients. As such, there is a continued need for improved cleaning compositions that can be used to clean articles of manufacture, such as textiles, polymer parts, metal parts, ceramic parts, or others.

SUMMARY

In one embodiment, a cleaning system can include a noble gas that can be converted to a supercritical fluid and a cleaning vessel. Also, the system can include one or more vessels configured to convert the noble gas into a supercritical fluid, or receive and clean an article of manufacture using the noble gas in the supercritical fluid state. The vessels can include a pressure unit configured to increase pressure of the noble gas to or past the supercritical pressure of the noble gas. The vessels can include a heating unit configured to increase temperature of the noble gas to or past the supercritical temperature of the noble gas. The vessels can include a separation vessel configured to receive the noble gas with one or more contaminants from a cleaning vessel and/or to decompress the noble gas to a gaseous state.

In one aspect, the cleaning system can include an additional substance selected from a different noble gas, a non-noble gas, organic solvent, solvent, water, oxidizing agent, a reducing agent, a fragrance, a detergent, bleaching agent, and combinations thereof to be combined with the noble gas in one or more vessels. The non-noble gas can be carbon dioxide, air, oxygen, or nitrogen. The solvent can be water, an alcohol, a phenol, an ester, a hydrocarbon, a halogenated hydrocarbon, a ketone, or an aldehyde. The oxidizing agent can be hydrogen peroxide, ozone, chlorite, chlorate, perchlorate, or hypochloride. The bleaching agent can include chlorine bleach, sodium hypochlorite, hydrogen peroxide, bleaching peroxide, calcium hypochlorite, or peroxide-releasing compound. The peroxide-releasing compound can include sodium perborate, sodium percarbonate, sodium persulfate, tetrasodium pyrophosphate, or urea peroxide. Also, the cleaning composition can include a catalyst to active the peroxide-releasing agent. The catalyst can include tetraacetylethylenediamine and/or sodium nonanoyloxybenzenesulfonate.

In one embodiment, a cleaning process can include: converting a noble gas into a supercritical fluid state; and cleaning an article of manufacture with the noble gas in the supercritical fluid state so as to remove one or more contaminants from the article of manufacture. The cleaning process can also include: introducing the noble gas in the supercritical fluid state into a cleaning vessel; introducing the article of manufacture into the cleaning vessel; and cleaning the article of manufacture with the noble gas in the supercritical fluid state within the cleaning vessel.

The cleaning process can also include converting the noble gas to a supercritical fluid state before being introduced into the cleaning vessel.

In one aspect, the cleaning process can include increasing the pressure of the noble gas to or past the supercritical pressure of the noble gas before being introduced into the cleaning vessel.

In one aspect, the cleaning process can include increasing temperature of the noble gas to or past the supercritical temperature of the noble gas before being introduced into the cleaning vessel.

In one embodiment, a cleaning composition can include: a noble gas in a supercritical fluid state; and a textile article of manufacture having or more contaminants.

In one embodiment, a cleaning composition can include: a noble gas in a supercritical fluid state; and one or more additional substances selected from the group consisting of a different noble gas, a non-noble gas, organic solvent, solvent, water, oxidizing agent, a reducing agent, a fragrance, a detergent, bleaching agent, and combinations thereof.

DETAILED DESCRIPTION

Figure 1:
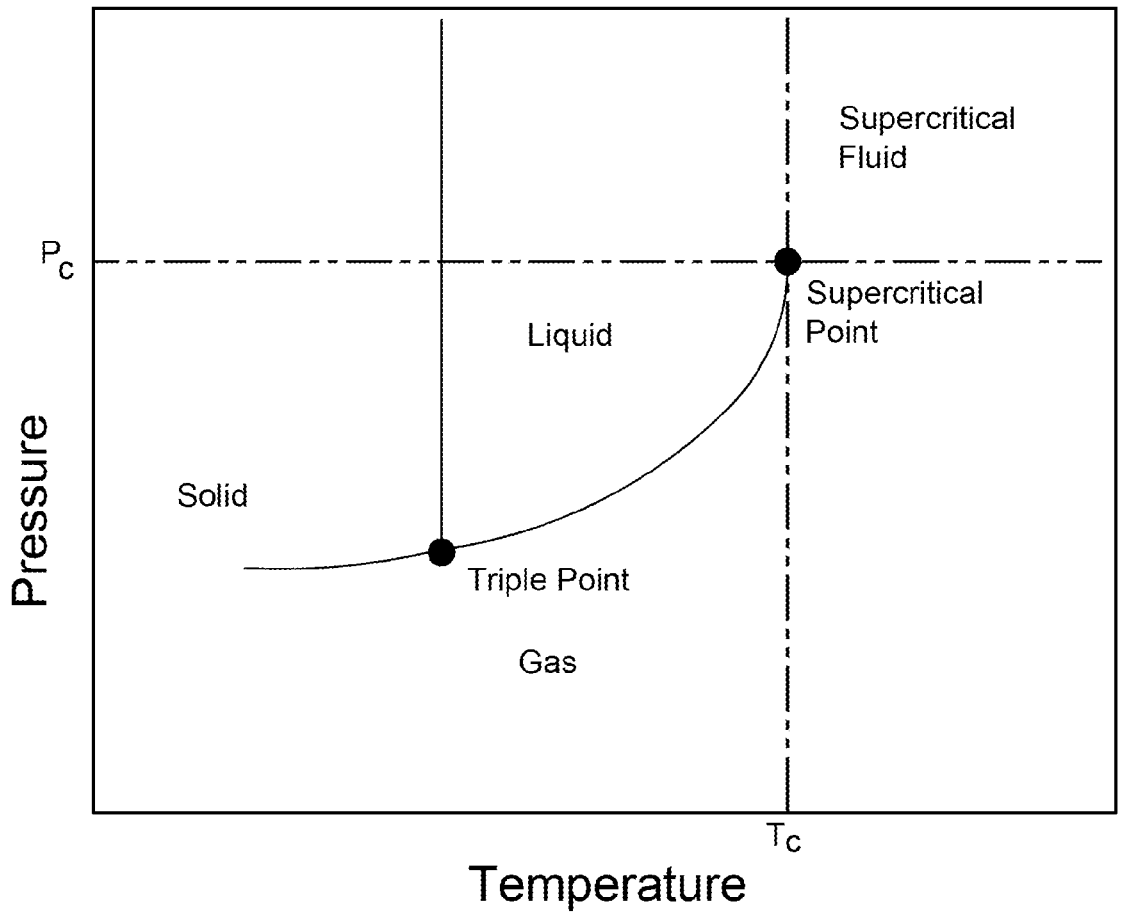
Fig. 1 (Prior Art)
FIG. 1 is a schematic of a prior art and generic phase diagram showing, solid, liquid, gas, and supercritical fluid phases.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

In view of the problems with cleaning substances being toxic, having negative environmental impacts, and being costly to prepare for disposal, it would be beneficial to have a new cleaning composition that does not have these toxicological and/or environmental consequences. It has now been found that a noble gas in the supercritical fluid state (e.g., supercritical noble gas) can be used as a non-toxic cleaning composition that has minimal to no harmful effects on the environment or on human health. Additionally, noble gases can be easily separated from the contaminants by converting the noble gas back to its gaseous state such that the contaminants from the cleaning process remain as solids or liquid. The gaseous noble gas can then be removed from the liquid and solid contaminants by venting the gas out of a vessel that retains the liquid and solid. Evaporation of the noble gas may also be useful for removing the noble gas from the contaminants.

FIG. 1 is a schematic graph that generally represents the solid, liquid, gas, and supercritical fluid states. The noble gases can include helium, argon, krypton, and xenon, or combinations thereof. However, radon may be useful in some applications where radioactivity is not problematic, such as in cleaning radioactive containers. The noble gases are substantially inert, non-toxic, and are colorless and tasteless. The noble gases can be converted to supercritical fluids by compression to or past their supercritical point, which makes the supercritical noble gases useful as cleaning agents for laundry and other industrial cleaning purposes, such as cleaning various articles of manufacture of fiber, textile, polymer, glass, ceramic, metal, semiconductor, or combinations thereof.

A noble gas becomes a supercritical fluid noble gas at a temperature and pressure above its supercritical point. The supercritical point, as shown in FIG. 1, is a well established phenomenon where a gas, such as a noble gas, converts to a supercritical fluid above the temperature (e.g., supercritical temperature) and pressure (e.g., supercritical pressure) of the supercritical point. As a supercritical fluid noble gas, it can diffuse through solids like a gas, and dissolve materials like a liquid. In addition, close to the supercritical point, small changes in pressure or temperature result in large changes in the density of the supercritical fluid, allowing many properties of a supercritical fluid noble gas to be "fine-tuned" to be more liquid like or more gas like. Relatively small decreases in temperature toward the supercritical point from temperatures near the supercritical can result in the supercritical fluid behaving closer to a fluid. Correspondingly, relatively small increases in the temperature away from supercritical point from temperatures near the supercritical can result in the supercritical fluid behaving closer to a gas. On the other hand, relatively small increases in pressure can increase the density of the supercritical fluid so that it behaves more like a liquid, whereas relatively small decreases in pressure reduce the density so that the supercritical fluid behaves more like a gas. In addition, there is no surface tension in a supercritical fluid, as there is no liquid/gas phase boundary.

Many contaminants are soluble in the noble gas supercritical fluid. Solubility in a supercritical fluid tends to increase with density of the fluid (at constant temperature). Since density increases with pressure, solubility tends to increase with pressure. At constant density, solubility will increase with temperature. However, close to the supercritical point, the density can drop sharply with a slight increase in temperature. Therefore, close to the supercritical temperature, solubility often drops with increasing temperature, and then rises again. These parameters can be modulated during cleaning so that the contaminants are removed from an article to be cleaned and suspended in the supercritical fluid to enhance cleaning processes.

For example, these parameters can be modulated in order to achieve cavitation or the formation of bubbles on the surfaces of the vessel as well as on the article within the vessel. Cavitation can be induced by varying the pressure (e.g., reduce pressure until boiling occurs), by physical agitation, by application of ultrasound which induces localized cavitation upon the surface, and possibly by microwaves. Cavitation can increase cleaning potential of the supercritical fluid. Cavitation would normally nucleate at surface irregularities upon the item being cleaned or on the vessel walls.

All supercritical fluids are miscible with each other. So for a mixture of supercritical fluids, a single phase can be obtained if the critical point of the mixture is exceeded. The supercritical point of a binary mixture can be estimated as the arithmetic mean of the supercritical temperatures and pressures of the two components:

$$T_{c(mix)}=(\text{mole fraction } A)\times T_cA+(\text{mole fraction } B)\times T_cB.$$

For greater accuracy, the supercritical point can be calculated using equations of state, such as the Peng Robinson, or group contribution methods. Other properties, such as density, can also be calculated using equations of state. Tertiary, quaternary, or other multiple substance combinations are also possible. Experimental methods can be useful for determining the supercritical point of compositions that have multiple substances that are combined for preparing the supercritical fluid. Also, engineering handbooks can be used for looking up values for tertiary systems.

Additionally, many gases may become supercritical fluids under proper pressure and temperature and, thereby, can be useful in forming cleaning compositions with a supercritical noble gas. For example, nitrogen has a supercritical point of about 126.2K (−147° C.) and about 3.4 MPa (34 bar or 33.56 atmospheres) and carbon dioxide ($CO_2$) has a supercritical point of about 31° C. and about 75 atmosphere Therefore, nitrogen or $CO_2$ in a gas cylinder (e.g., an example of a storage vessel described below) above their respective supercritical point (or compressed air) is a supercritical fluid and may be used in combination with a supercritical noble gas for cleaning purposes.

The noble gases are a series of gases that have their valence of s2 (helium) or s2p6 (neon, argon, krypton, and xenon) completely filled, and as such are inert to chemical reactions. Argon constitutes about 1% of earth's atmosphere and is plentiful. The abundance of krypton in the atmosphere is thought to be about 0.000108-0.000114%, making it the seventh most common gas in the atmosphere. Xenon is a trace gas in Earth's atmosphere. Thus, there is sufficient source of noble gases so that their use in cleaning compositions can be cost effective even without considering the added benefit of improved personal safety and reduced environmental impact.

Supercritical noble gases as cleaning agents offer numerous advantages when comparing to conventional cleaning compositions. Supercritical noble gases are capable of dissolving and/or absorbing a wide variety of contaminants including the contaminants previously cleaned with detergents, toxic solvents, or supercritical $CO_2$. The supercritical noble gases may have similar or better dissolving and/or absorbing parameters compared to $CO_2$. As such, supercritical noble gases can be used for cleaning articles of manufacture (e.g., textiles) equally as well if not better than supercritical $CO_2$. Supercritical noble gases may have a broader application in the cleaning industry than $CO_2$. Currently, cleaning with $CO_2$ is largely limited to synthetic fibers due to carbon dioxide's reactivity with natural fibers such as wool, cellulose, or proteins. Because of their chemical inertness, supercritical noble gases will be useful in cleaning materials that cannot be cleaned with $CO_2$. Supercritical noble gases offer other distinct advantages as they are not carcinogens or mutagens, they do not destroy the ozone layer, they do not behave as green house gases, they are completely volatile organic compound (VOC) compliant, and they have no known short or long term health consequences.

The contaminants to be cleaned from the article can be mixable or miscible with the supercritical noble gas. By being "mixable" or "miscible" it is meant that the contaminants can be dissolvable, suspendable, absorbable, or otherwise capable of being partitioned into the supercritical noble gas through any other physical or chemical action or force.

Supercritical fluids of the noble gases can be used as cleaning agents under supercritical conditions. Argon has a supercritical temperature and pressure of about −122° C. and about 50 atmospheres. Xenon has a supercritical point of about 17° C. and about 60 atmospheres. Helium has a supercritical point of about −267.96° C. and about 2.24 atmospheres. Krypton has a supercritical point of about −63.74° C. and about 54.28 atmospheres. Neon has a supercritical point of about −228.75° C. and about 27.24 atmospheres. For comparison, the carbon dioxide supercritical pressure is about 75 atmospheres and supercritical temperature is about 31° C. Therefore, supercritical applications using carbon dioxide typically operate at temperatures between about 32 and about 49° C. and pressures between about 75 and about 250 atmospheres. At temperatures between about 32 and about 49° C., the operational pressure for argon would roughly be between about 350-500 atmospheres, which is easily obtainable by modern compression technology. Xenon would roughly be between about 75 and about 250 atmospheres.

Under these conditions, an article of manufacture can be cleaned with supercritical noble gas to remove one or more contaminants from the article of manufacture in less than about 30 minutes (e.g., about 1 minute to about 30 minutes), less than about 20 minutes (e.g., about 5 minutes to about 30 minutes), or even less than about 15 minutes (e.g., about 10 minutes to about 15 minutes), where about 12 minutes can be an example of a cleaning time. Such supercritical noble gas can be used to clean in a manner similar to cleaning processes performed with supercritical carbon dioxide ($CO_2$) under moderate pressure and temperature conditions that are easily obtainable with industrial heaters, compressors, and pressurizers.

In one embodiment, the article of manufacture to be cleaned can include a textile article of manufacture having one or more contaminants. A textile is a flexible material consisting of a network of natural or artificial fibers often referred to as thread or yarn. Yarn is produced by spinning raw wool fibers, linen, cotton, or other material on a spinning wheel to produce long strands. Textiles are formed by weaving, knitting, crocheting, knotting, or pressing fibers together (felt). The words fabric and cloth are used in textile assembly trades (such as tailoring and dressmaking) as synonyms for textile. Textile refers to any material made of interlacing fibers. Fabric refers to any material made through weaving, knitting, crocheting, or bonding. Cloth refers to a finished piece of fabric that can be used for a purpose such as covering a bed. Examples of textiles that are non-limiting can include clothing, containers, bags, baskets, carpeting, upholstered furnishings, window shades, towels, coverings for tables, beds, and other flat surfaces, filters, flags, backpacks, tents, nets, cleaning devices, handkerchiefs, rags, balloons, kites, sails, parachutes, rope, floor mats, doormats, brushes, mattresses, floor tiles, and sacking, or others. Textile materials can include animal hairs, wool, silk, grass, rush, hemp, sisal, coconut fiber, straw, bamboo, cotton, flax, jute, hemp, modal and even bamboo fiber, polyester, aramid fibers, acrylic fibers, nylon fibers, spandex, olefin fibers, lurex, or others.

In one embodiment, the article of manufacture can be made of a metal or metal alloy. Industrial parts or machinery can be cleaned with the cleaning process described herein. Any type of metal or alloy is suitable, such as without limitation, steel, stainless steel, nitinol, aluminum, or others.

In one embodiment, the article of manufacture can be made of a ceramic. Dishes, pottery, bricks, pipes, floor, roof tiles, porcelain, china or others can be articles of manufacture prepared from a ceramic. Examples of ceramic materials that are non-limiting can include alumina oxide, zirconia oxide, carbides, borides, nitrides, silicides, or others.

In one embodiment, the article of manufacture can be a polymer or plastic article. The polymer or plastic can be resistant to the conditions of the cleaning process, such as temperature and pressure, so as to be stable and not significantly degrade during the cleaning. Polyurethanes, polycarbonates, polyacrylamides, or others are non-limiting examples.

Also, the supercritical noble gas can be combined with one or more oxidant materials in some cleaning applications, such as for industrial cleaning of manufacturing components or articles of manufacture that may be contaminated. The noble gas and oxidant material can be converted to a supercritical fluid and contacted with the contaminated article at a temperature at or above the supercritical temperature of the noble gas and oxidant material composition and a pressure at or above the supercritical pressure of the noble gas and oxidant material composition. The use of the oxidant material can be useful in applications that increase cleaning efficiency by oxidizing the contaminant material to provide the cleaned article. For example, if a contaminant is chemically bound to an article, the oxidizing material may oxidize the bond to cleave the contaminant from the article. Non-limiting examples of oxidant materials can include oxygen, ozone, hydrogen peroxide, chlorine, nitric oxide, nitrous oxide, nitrogen dioxide, nitrogen trifluoride, fluorine, and chlorine trifluoride. The ratio of noble gas to oxidant material can range from about 10:1 to about 1:1, about 8:1 to about 1:1, or about 5:1 to about 1:1, or vice versa. The duration of cleaning can be similar to the length of time described herein or even shorter due to the oxidant material cleaning ability. In one aspect, an embodiment of the cleaning composition specifically excludes the use of an oxidizing material in the noble gas supercritical fluid cleaning composition that is environmentally friendly.

Supercritical noble gas can be combined with one or more hydrocarbons for use in the cleaning purposes. Mixtures of supercritical noble gases with hydrocarbons can be useful in cleaning semiconductors. Also, the supercritical noble gases greatly reduce the amount of hydrocarbon solvents typically used during cleaning. For example, argon can be combined with butane and formed into a supercritical mixture of about 1:2 to about 1:3 argon/butane, however, the ratio could range from about 10:1 to about 1:1, about 8:1 to about 1:1, or about 5:1 to about 1:1, or vice versa. The mixture can be converted to a supercritical fluid by obtaining a pressure of about 34 MPa (335 atmospheres) and temperature of about 20° C. The argon/butane can be used to clean the article for a duration recited herein or less. Other hydrocarbons that can be combined with a supercritical noble gas can include without limitation methane, ethane, propane, butane, ethylene, propylene, or any C1-C20 hydrocarbon that is substituted or unsubstituted with functional groups, or branched or un-branched, or straight chain or ring configuration. In one aspect, an embodiment of the cleaning composition specifically excludes the use of a hydrocarbon in the noble gas supercritical fluid cleaning composition that is environmentally friendly.

The supercritical noble gas can also be combined with one or more additional gases in order to prepare the cleaning composition. The additional gases can be used to modulate the van der Waals forces, which can change from noble gas to noble gas. As such, induced dipole is larger as the noble gas becomes heavier, and the additional gases can counteract or amplify these changes. Also, the noble gas can become softer in character (hard/soft theory) as the gas becomes heavier, and the additional gases can counteract or amplify these changes. The additional gases can be used to counteract or amplify these properties to change the solubility parameters of the supercritical noble gas fluids and thereby allow for improved ability to remove contaminants. Non-limiting examples of gases that can be used include a different noble gas, carbon dioxide, air, oxygen, nitrogen, or others. It can be beneficial for the additional gas to be non-reactive or have a minimal reactive profile in the conditions suitable for cleaning a particular article with the supercritical fluid. The ratio of noble gas to additional gas can range from about 10:1 to about 1:1, about 8:1 to about 1:1, or about 5:1 to about 1:1, or vice versa. The duration of cleaning can be similar to the length of time described herein or even shorter. In one aspect, an embodiment of the cleaning composition specifically excludes the use of an additional gas in the noble gas supercritical fluid cleaning composition.

The supercritical noble gas can also be combined with water to form a cleaning composition. Water is commonly used in many cleaning applications. However, water cannot be mixed with carbon dioxide because water reacts with carbon dioxide to form carbonic acid and carbonates. Water can be combined with the supercritical noble gases so that the cleaning ability of water can be used in a supercritical fluid. Mixing water with noble gases can produce supercritical fluids that dissolve highly ionic species while still reducing water waste since it does not take much water to give the desired effect. While the use of supercritical noble gases can replace the use of water and reduce the environmental impact of cleaning, use of some water in supercritical cleaning compositions can provide an appreciable benefit due to the polarity of the water molecule. The ratio of noble gas to water can range from about 10:1 to about 1:1, about 8:1 to about 1:1, or about 5:1 to about 1:1, or vice versa. The duration of cleaning can be similar to the length of time described herein or even shorter due to the cleaning ability of water. In one aspect, an embodiment of the cleaning composition specifically excludes the use of water in the noble gas supercritical fluid cleaning composition for an environmentally friendly cleaning composition.

The supercritical noble gas can also be combined with one or more alcohols to prepare a cleaning composition. Alcohols have been employed as cleaners to remove oils, dirt, and dust, and can be useful as a disinfectant for various microbes. However, alcohols cannot be mixed with carbon dioxide because the alcohols react with carbon dioxide to form organo-carbonates. Alcohols can be combined with the supercritical noble gases so that the cleaning ability of alcohols can be used in a supercritical fluid. Non-limiting examples of suitable alcohols include methanol, ethanol, propanol, n-propanol, isopropanol, or others. The ratio of noble gas to alcohol can range from about 10:1 to about 1:1, about 8:1 to about 1:1, or about 5:1 to about 1:1, or vice versa. The duration of cleaning can be similar to the length of time described herein or even shorter due to the cleaning ability of alcohol. In one aspect, an embodiment of the cleaning composition specifically excludes the use of an alcohol in the noble gas supercritical fluid cleaning composition for an environmentally friendly cleaning composition.

The supercritical noble gas can also be combined with an organic solvent to form a cleaning composition where the organic solvent can facilitate cleaning. Initially, the contaminants can be soluble or absorbable into an organic solvent so that the contaminants can more easily partition into the supercritical fluid upon exposure thereto, which can increase the ability to clean contaminants from an article of manufacture. The organic solvent can be especially suitable for being combined with the supercritical noble gas to clean articles of manufacture that are contaminated with hydrophobic or organic solvent-compatible contaminants. Examples of organic solvents can include but are not limited to acetone, toluene, turpentine, methyl acetate, ethyl acetate, hexane, petrol ether, citrus terpenes, n-pentane, ethylene dichloride, dioxane, dimethyl sulfoxide, acetonitrile, pyridine, acetic acid, THF, methyl isobutyl ketone, methylene chloride, isooctane, cyclohexane, cyclopentane, carbon disulfide, carbon tetrachloride, o-xylene, benzene, diethylether, chloroform, various halogenated hydrocarbons, and others. The ratio of noble gas to solvent can range from about 10:1 to about 1:1, about 8:1 to about 1:1, or about 5:1 to about 1:1, or vice versa. The duration of cleaning can be similar to the length of time described herein or even shorter due to the solvating ability of the solvent. In one aspect, an embodiment of the cleaning composition specifically excludes the use of an organic solvent in the noble gas supercritical fluid cleaning composition to be more environmentally friendly.

The supercritical noble gas can also be combined with a bleaching agent. Non-limiting examples of bleaching agents can include chlorine bleach, sodium hypochlorite, hydrogen peroxide, bleaching peroxide, calcium hypochlorite, or peroxide-releasing compound. The peroxide-releasing compound can include sodium perborate, sodium percarbonate, sodium persulfate, tetrasodium pyrophosphate, or urea peroxide. When a peroxide-releasing agent is included, the composition can also include a catalyst to active the peroxide-releasing agent. Non-limiting examples of catalysts can include tetraacetylethylenediamine and/or sodium nonanoyloxybenzenesulfonate.

The supercritical noble gas can also be combined with one or more aroma compounds (e.g., fragrances) that can beneficially provide a nice smell to the article being cleaned, which can be advantageous especially for textiles. For example without limitation the aroma compound can be fragrances, essential oils, perfumes, methyl formate, methyl acetate, methyl butyrate, methyl butanoate, ethyl acetate, ethyl butyrate, ethyl butanoate, isoamyl acetate, pentyl butyrate, pentyl butanoate, pentyl pentanoate, octyl acetate, myrcene, geraniol, nerol, citral, lemonal, citronellal, citronellol, linalool, nerolidol, limonene, camphor, terpineol, alpha-ionone, thujone, benzaldehyde, eugenol, cinnamaldehyde, ethyl maltol, vanillin, anisole, anethole, estragole, thymol, or others. However, in some instances it may be desired to provide a noxious odor to the article being cleaned, such as when marking an item for an undesirable scent to keep animals or people away from the article. Non-limiting examples of aroma compounds that are noxious odorants can include trimethylamine, putrescine, diaminobutane, cadaverine, pyridine, indole, skatole, or others. The ratio of noble gas to aroma compound can range from about 10:1 to about 1:1, about 8:1 to about 1:1, or about 5:1 to about 1:1, or vice versa. The duration of cleaning can be similar to the length of time described herein or even shorter in some instances if the aroma compound can facilitate cleaning. In one aspect, an embodiment of the cleaning composition specifically excludes the use of an aroma compound in the noble gas supercritical fluid cleaning composition to provide a scentless composition.

The supercritical noble gas can be combined with one or more detergents to enhance the cleaning function of the cleaning composition. Examples of detergents include soaps, saponins, foaming surfactant mixture, non-foaming surfactant mixture, anionic surfactants, cationic surfactants, glycerides (mono, di, and tri), or others. Laundry detergents are a broad class of detergent examples. The ratio of noble gas to detergent can range from about 10:1 to about 1:1, about 8:1 to 1:1, or about 5:1 to about 1:1, or vice versa. The duration of cleaning can be similar to the length of time described herein or even shorter due to the solvating ability of the detergent. In one aspect, an embodiment of the cleaning composition specifically excludes the use of a detergent in the noble gas supercritical fluid cleaning composition to provide a detergentless cleaning composition.

The supercritical noble gas can also be combined with one or more cleaners. Examples of such cleaners without limitation include ammonia, vinegar, bleach, chelators, or others. The ratio of noble gas to cleaner can range from about 10:1 to about 1:1, about 8:1 to about 1:1, or about 5:1 to about 1:1, or vice versa. The duration of cleaning can be similar to the length of time described herein or even shorter due to the solvating ability of the cleaner. In one aspect, an embodiment of the cleaning composition specifically excludes the use of an additional cleaner in the noble gas supercritical fluid cleaning composition to provide a cleaning composition for articles that are not compatible with these cleaners. In one embodiment, ammonia, vinegar, bleach, chelators, or others may be specifically excluded as they may react unfavorably with carbon dioxide in some instances.

The supercritical noble gas can also be combined with pH adjusters, such as but not limited to various buffer agents. Non-limiting examples of pH adjusters include weak acids, weak bases, bicarbonates, ammonias, phosphates, monosodium phosphate, disodium phosphate, hydrochloric acid, sodium citrate, citric acid, acetic acid, sodium acetate, borax, sodium hydroxide, 3-{[tris(hydroxymethyl)methyl]amino}propanesulfonic acid, N,N-bis(2-hydroxyethyl)glycine, tris(hydroxymethyl)methylamine, N-tris(hydroxymethyl)methylglycine, 4-2-hydroxyethyl-1-piperazineethanesulfonic acid, or others. The ratio of noble gas to pH adjuster can range from about 10:1 to about 1:1, about 8:1 to about 1:1, or about 5:1 to about 1:1, or vice versa. The duration of cleaning can be similar to the length of time described herein or even shorter. In one aspect, an embodiment of the cleaning composition specifically excludes the use of a pH adjuster in the noble gas supercritical fluid cleaning composition when pH adjustment is not needed or desired. These pH adjusters can be favorably used because they do not react with the supercritical noble gases, where the pH adjusters may be avoided in carbon dioxide systems due to the reactivity with carbon dioxide.

The supercritical noble gas can also be combined with a fabric softener, especially when cleaning textiles or fabrics. Non-limiting examples can include water emulsions (e.g., with soap, olive oil, corn oil, or tallow oil), quaternary ammonium salts with one or more long alkyl chains, silicone based compounds (e.g., polydimethylsiloxane), antistatic agents (e.g., salts of mono or di esters of phosphoric acid and fatty alcohols), or others. The ratio of noble gas to fabric softener can range from about 10:1 to about 1:1, about 8:1 to about 1:1, or about 5:1 to about 1:1, or vice versa. The duration of cleaning can be similar to the length of time described herein or even shorter. In one aspect, an embodiment of the cleaning composition specifically excludes the use of a fabric softener in the noble gas supercritical fluid cleaning composition for a cleaning composition for individuals that are allergic to fabric softener.

The supercritical noble gas can also be combined with surfactants, such as anionic, cationic, nonionic, or zwitterionic surfactants. Non-limiting examples can include perfluorooctanoate, sodium dodecyl sulfate, sodium laureth sulfate, alkyl benzene sulfonate, cetyl trimethylammonium bromide, benzalkonium chloride, dodecyl betaine, cocamidopropyl betaine, alkyl poly(ethylene oxide), octyl glucoside, cetyl alcohol, polysorbates, or others. In some instances, the surfactants are used as detergents. The ratio of noble gas to surfactant can range from about 10:1 to about 1:1, about 8:1 to about 1:1, or about 5:1 to about 1:1, or vice versa. The duration of cleaning can be similar to the length of time described herein or even shorter due. In one aspect, an embodiment of the cleaning composition specifically excludes the use of a surfactant in the noble gas supercritical fluid cleaning composition for articles that are not compatible with surfactants. These surfactants can be favorably used because they do not react with the supercritical noble gases, whereas some of the surfactants may be avoided in carbon dioxide systems due to the reactivity with carbon dioxide.

The supercritical noble gas can also be combined with abrasives that can use the physical impact of the abrasive on the article or contaminants so as to remove the contaminants. Non-limiting examples of abrasive materials, such as abrasive particles, can include calcite, emery, diamond (e.g., natural or synthetic), novaculite, pumice dust, rouge, sand, zirconia alumina, borazon, ceramic, ceramic aluminum oxide ceramic iron oxide, aluminium oxide, glass powder, steel abrasive, silicon carbide or others. The ratio of noble gas to abrasive can range from about 10:1 to about 1:1, about 8:1 to about 1:1, or about 5:1 to about 1:1, or vice versa. The duration of cleaning can be similar to the length of time described herein or even shorter due to the ability of the abrasive to impact the contaminants. In one aspect, an embodiment of the cleaning composition specifically excludes the use of an abrasive in the noble gas supercritical fluid cleaning composition for cleanings where abrasives should be avoided.

The supercritical noble gas can also be combined with enzymes to digest proteins, fats, carbohydrates, or other substances in order to facilitate or improve cleaning Examples of enzymes that are non-limiting include proteases, amylases, lipases, or cellulases. Any type of enzyme may be useful in preparing a supercritical fluid cleaning composition. The ratio of noble gas to enzyme can range from about 10:1 to about 1:1, about 8:1 to about 1:1, or about 5:1 to about 1:1, or vice versa. The duration of cleaning can be similar to the length of time described herein or even shorter due to the ability of the enzyme to break down contaminants. In one aspect, an embodiment of the cleaning composition specifically excludes the use of an enzyme in the noble gas supercritical fluid cleaning composition for cleaning compositions that are protein-free. The enzymes can be favorably used because they do not react with the supercritical noble gases, where enzymes may be avoided in carbon dioxide systems due to the reactivity with carbon dioxide.

In one embodiment, the additional substance combined with the supercritical noble gas can be capable of either being in a supercritical fluid state when the noble gas is in a supercritical fluid state or the substance is absorbable into the noble gas in the supercritical state. In some instances, the additional substance can have a supercritical point that allows the substance to be in a supercritical fluid state along with the noble gas. In other instances, the combination of the noble gas and additional substance(s) can have a supercritical point were the combination is a supercritical fluid above the supercritical point (e.g., above the supercritical temperature and supercritical pressure for the composition). In other instances, the additional substance can be dissolved or solvated by or into the supercritical noble gas. Also, the additional substance can be absorbed or suspended in the supercritical noble gas. For example, the abrasives can be suspended in the supercritical noble gas. In any event, the supercritical noble gas can form a composition with the additional substance(s) located therein such that the combination of the supercritical noble gas and additional substance can function in a cleaning process to remove contaminants from an article of manufacture. These additional ingredients allow the cleaning composition to be tailored for a particular cleaning purpose.

In some instances, the supercritical noble gas can be combined with perchloroethylene and/or tetrachloroethylene to provide a cleaning composition. However, the negative environmental or health impact of these compounds may be reduced by excluding either of perchloroethylene and/or tetrachloroethylene from a cleaning composition. Similarly, some cleaning composition may include siloxane, but more environmentally friendly compositions may exclude the siloxane.

In one embodiment, the additional substance can have a supercritical pressure that is lower than the supercritical pressure of the noble gas, and/or the additional substance can have a supercritical temperature that is lower than the supercritical temperature of the noble gas. Also, the additional substance can have a supercritical pressure that is higher than the supercritical pressure of the noble gas, and/or the additional substance can have a supercritical temperature that is higher than the supercritical temperature of the noble gas. In another example, the supercritical noble gas and additional substance can be prepared as a supercritical fluid at a temperature range from about −50° C. to about 50° C., or from about −150° C. to about 150° C., or from about −273° C. to about 500° C. and/or at a pressure range from about 50 atm to about 400 atm, or from about 300 atm to about 600 atm, or from about 1 atm to about 2000 atm. Also, the supercritical point of a composition of noble gas and additional substance can be obtained through routine experimentation, and the supercritical point can depend on the nature of the additional substance. Accordingly, the supercritical noble gas and additional substance can be at a temperature and pressure above the supercritical pressure and/or supercritical temperature of the mixture.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent processes and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

In one embodiment, a cleaning system can include a noble gas composition that can be converted to a supercritical fluid. Such a cleaning system, as shown in FIGS. 2A-2C, can also include one or more vessels that are configured to convert the noble gas into a supercritical fluid and/or receive and clean an article of manufacture with the noble gas in the supercritical fluid state.

Figure 2A:
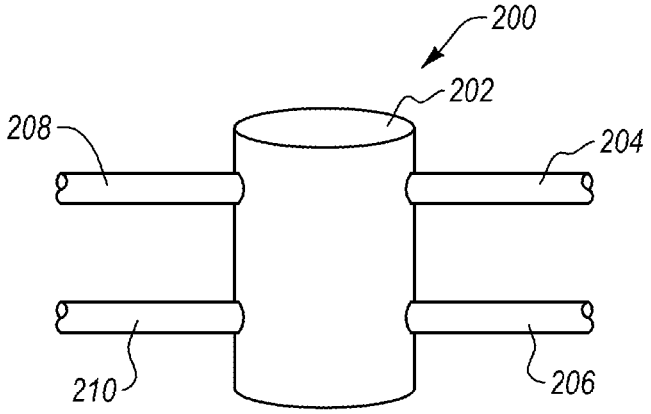
FIGS. 2A-2C are schematic diagrams of illustrative embodiments of cleaning vessels.
Figure 2B:
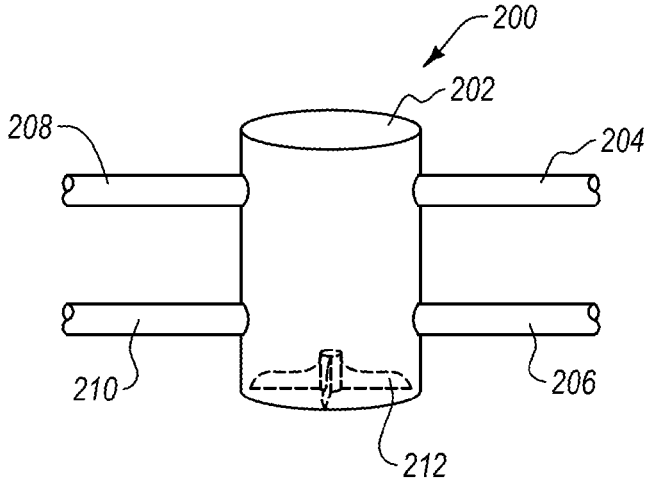
Figure 2C:
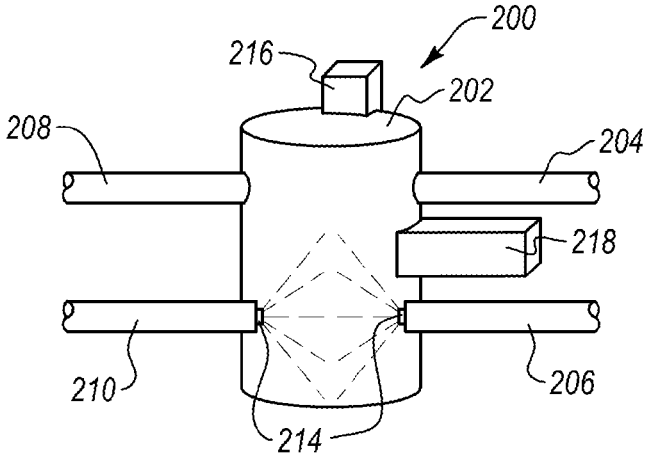

FIGS. 2A-2C show illustrative embodiments of cleaning vessels 202 that can be configured to clean an article (not shown). In FIGS. 2A-2C, features are shown as schematic representations in order to identify the presence of a feature, while the shape, size, or operational configuration of the feature may differ from that which is actually shown. One of skill in the art will recognize that the schematic representations illustrate that a feature may be present, but that the feature may different in appearance from the example shown in the figures. The cleaning vessel 202 can be configured as any chemical reaction vessel that is capable of operating at the high temperatures and pressures and having means (e.g., ports, doors, inlets or the like) for receiving/removing the article of manufacture to be cleaned as well as the supercritical fluids. The cleaning vessel 202 can include any type of shape of standard chemical reactors, such as spherical, cylindrical, cubic, or other. The cleaning vessel 202 can be made of inert metals such as stainless steel and titanium, as well as others.

The cleaning vessel 202 may also include a computing system and/or controller (not shown) that can receive instructions and operate the cleaning vessel 202 as well as the doors or valves associated therewith. The computing system and/or controller can be configured as is well known in chemical processing systems and can communicate with other computing systems and/or controllers of other components in the cleaning system. As such, the computing system and/or controller can be communicatively coupled with a communication network.

The cleaning vessel 202 can include features found on common reaction vessels that are found in laboratory and/or industrial settings. As such, the cleaning vessel 202 can include one or more inlets with doors or valves that can selectively open or close the inlet to allow an article or supercritical gas to enter into the cleaning vessel 202 or close and stop any additional material from entering into the cleaning vessel 202. For example, a door inlet can be useful for moving an article into or out from the cleaning vessel 202 while a valve inlet can be useful for receiving the supercritical fluid or removing the contaminated supercritical fluid from the cleaning vessel 202.

The cleaning vessel 202 is associated with a noble gas source 204 that provides the noble gas to the cleaning vessel 202 in a liquid, gas, or supercritical state, as well as in a cleaning composition that includes one or more additional substances combined with the noble gas. The noble gas source 204 is a schematic representation of an inlet, port, or the like that can supply the noble gas into the cleaning vessel 202. The noble gas source 204 is shown as a tube that can supply the noble gas to the cleaning vessel 202, and it may include valves, controllers, or other features for supplying the noble gas into the cleaning vessel 202. The noble gas source 204 is shown substantially as a tube that can be connected to a processing component, such as a supercritical vessel that converts the noble gas into a supercritical fluid, that provides the noble gas to the cleaning vessel 202. Since the noble gas is provided into the cleaning vessel 202 as a fluid, the noble gas source 204 can have any suitable configuration for supplying such a fluid.

The cleaning vessel 202 is also associated with an article source 206 configured for providing the article to be cleaned into the cleaning vessel 202. The article source 206 is a schematic representation of an inlet, port, door, or the like that can supply the article (e.g., one or more objects) into the cleaning vessel 202. The article source 206 is shown as a tube that can supply the article to the cleaning vessel 202, and it may include valves, controllers, or other features for supplying the article into the cleaning vessel. The article source 206 is shown substantially as a tube that can be connected to a supply of the article; however, the actual appearance of the article source 206 may be different from the illustration. The article source 206 can include conveyers to carry the article, augers for moving the article when in a particulate form (e.g., plastic pellets), or mechanical components for obtaining the article and supplying the article into the cleaning vessel 202.

The cleaning vessel 202 can also be associated with noble gas outlet 208 that provides for the noble gas and contaminants to be removed from the cleaning vessel 202 and away from the article. The cleaning process can remove contaminants from the article being cleaned, and such contaminants can be dissolved, suspended, or otherwise absorbed into the supercritical fluid so that they can be removed from the article and then from the cleaning vessel 202 in any manner sufficient for fluid removal. The noble gas outlet 208 may be configured similarly as the noble gas inlet 204; however, the direction of flow is out from the cleaning vessel 202. Accordingly, the noble gas outlet 208 is a schematic representation of an outlet, port, or the like that can remove the noble gas and contaminants from the cleaning vessel 202. The noble gas outlet 208 is shown as a tube that can remove the noble gas and contaminants from the cleaning vessel 202, and may include valves, controllers, or other features for removing the noble gas and contaminants from the cleaning vessel 202. The noble gas outlet 208 is shown substantially as a tube that can be connected to a later processing component, such as a vessel that converts the noble gas from being supercritical into being a gas state. Since the noble gas is removed from the cleaning vessel 202 as a fluid, the noble gas outlet 208 can have any suitable configuration for supplying such a fluid.

Additionally, the cleaning vessel 202 can be associated with an article outlet 210 that provides for the removal of the article from the cleaning vessel 202, and which can be configured similarly to the article source 206. The article outlet 210 can be configured similarly as the article source 206. The article outlet 210 is a schematic representation of an inlet, port, door, or the like that can be used to remove the article (e.g., one or more objects) from the cleaning vessel 202. The article outlet 210 is shown as a tube that can move the article from the cleaning vessel 202 and supply the article to storage or for further processing, and it may include valves, controllers, or other features for removing the article from the cleaning vessel 202. The article outlet 210 is shown substantially as a tube; however, the actual appearance of the article outlet 210 may be different from the illustration. The article outlet 210 can include conveyers to carry the article, augers for moving the article when in a particulate form (e.g., plastic pellets), or mechanical components that can physically move the article.

Optionally, the article source 206 and article outlet 210 can be the same component. Also, the noble gas source 204 can be the same component as the noble gas outlet 208.

The cleaning vessel 202 is shown to be devoid of any mechanical agitating components and the cleaning can be performed by the supercritical noble gas interacting with the article by being passed over, around, through, or in contact with the article. The status of the noble gas as a supercritical fluid can absorb the contaminants from the article being cleaned into the supercritical fluid so that the contaminants are able to be removed from the article. The noble gas source 204 and noble gas outlet 208 may be in continuous operation so that new noble gas is continually introduced into the cleaning vessel 202 and contaminated noble gas with contaminants is continually removed from the cleaning vessel 202, which can cause a supercritical fluid current or flow that moves through the cleaning vessel 202. Also, the cleaning vessel 202 can be outfitted with nozzles (FIG. 2C), blowers (not shown), or other fluidic components that can induce the supercritical fluid to flow within the cleaning vessel 202 and contact the article so that contaminants are removed and absorbed into the supercritical fluid. Also, the supercritical fluid can have a circulatory environment within the cleaning vessel 202, such as by convection, that circulates the colorant over, around, or through the article. Also, pressure cycling, which is described in more detail below, within the cleaning vessel 202 can facilitate the cleaning.

FIG. 2B shows a cleaning vessel 202 with a mechanical agitator 212; however, multiple agitators 212 can be used. Mechanical agitators 212 are well known components of chemical processing and can use any of a variety of agitating members to agitate the supercritical fluid as well as the article. The mechanical agitator 212 can be configured similarly as any stirring, mixing, or kneading device, which are well known or as a washing machine-like agitator. Also, the mechanical agitator 212 may be associated with a controller such that it is controllable or programmable, where the controller may be communicatively coupled with a central computing system or controller.

FIG. 2C shows a cleaning vessel with two nozzles 214 than can be used to direct the supercritical noble gas over the article; however, one or multiple nozzles can be used. The nozzles 214 can be located at any suitable position within the cleaning vessel 202 so that the nozzles 214 blow the supercritical fluid over the holder 211 and/or the article. The nozzles 214 can be fluidly coupled with the noble gas source 204 so that fresh supercritical fluid is blown, or the nozzles can be coupled with a pump to recycle supercritical fluid with or without the contaminants and blow the supercritical fluid with or without the contaminants.

Additionally, FIG. 2C shows that the cleaning vessel 202 can be outfitted with temperature controlling components 216 that can allow for the cleaning vessel to modulate the temperature of the noble gas to above and/or below the supercritical temperature. The temperature controlling components 216 can include without limitation heaters, heat transfer components, heat exchangers, heating jackets, coolers, refrigeration components, cooling jackets, or other temperature controlling components 216. Also, FIG. 2C shows that the cleaning vessel 202 can be outfitted with pressure controlling components 218 that can modulate the pressure above and/or below the supercritical pressure. The pressure controlling components 218 can include without limitation pumps, pressurizers, bleed valves, compressors, or others. Temperature controlling components and pressure controlling components are well known in the art. Thus, the cleaning vessel 202 can receive the supercritical noble gas and/or convert the noble gas to a supercritical fluid, and back again to a gas or liquid noble gas.

Additionally, the cleaning vessel 202 of FIG. 2C can include nozzles 214 that are configured to direct flow of the supercritical noble gas onto or at the article. The nozzles 214 can blow fresh supercritical noble gas, or the cleaning vessel 202 can include pumps or sprayers that can blow supercritical gas from within the cleaning vessel out from the nozzles 214.

Figure 3:
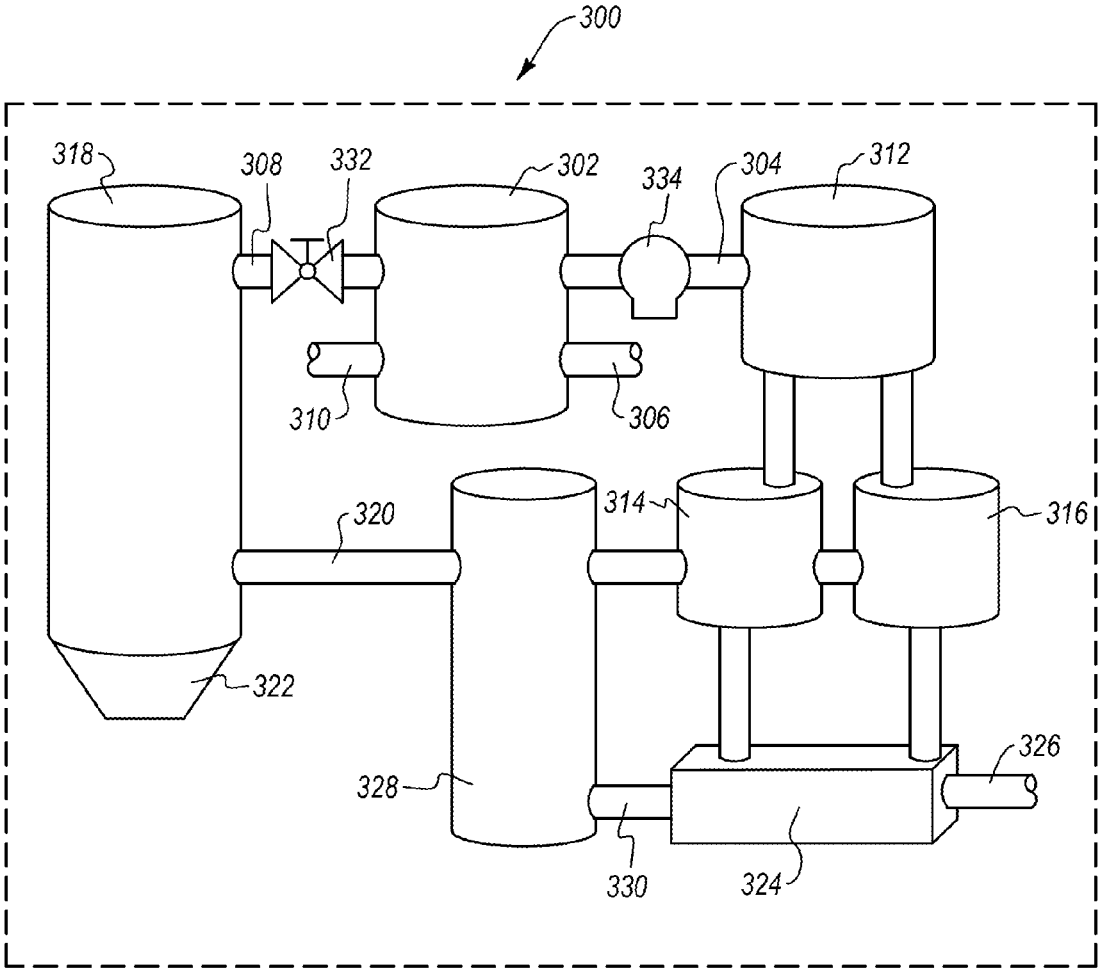
FIG. 3 is a schematic diagram of an illustrative embodiment of a cleaning system.

FIG. 3 shows another example of a cleaning system 300 for use with supercritical noble gases. Similar with FIG. 2A, the cleaning system 300 can include a cleaning vessel 302 associated with a noble gas inlet 304, an article inlet 306, a noble gas outlet 308, and an article outlet 310, where one or more of these components can be combined. The noble gas inlet 304 can receive the noble gas from a supercritical fluid vessel 312 configured to convert the noble gas to a supercritical fluid, such as by modulating the temperature and/or pressure.

In some instances, the functionality of the supercritical fluid vessel 312 can be accomplished with a pressure unit 314 and/or a temperature unit 316. As such, the pressure unit 314 and/or temperature unit 316 can be fluidly coupled with the noble gas inlet 304, and further can be fluidly coupled with each other so that both temperature and pressure can be modulated to convert the noble gas to a supercritical fluid. The pressure unit 314 can be configured to increase pressure of the noble gas to or past the supercritical pressure of the noble gas. The temperature unit 316 can include heating components and function as a heater to heat the noble gas above the supercritical temperature. Also, the temperature unit 316 can include cooling components in the instance that the supercritical noble gas should need to be cooled before cleaning a particular article. The supercritical fluid vessel 312, pressure unit 314, and/or temperature unit 316 can provide the supercritical noble gas to the a cleaning vessel 302, which is configured to receive the noble gas in a supercritical fluid state and to receive an article of manufacture to be cleaned.

FIG. 3 also shows that the cleaning system 300 can be capable of recycling the noble gas for use in subsequent cleaning processes. As shown, the cleaning vessel 302 is coupled to a separation vessel 318 configured to receive the noble gas with one or more contaminants from a cleaning vessel and to decompress the noble gas to a gaseous state so that the noble gas can be separated from the one or more contaminants. Once the noble gas and contaminants are separated, the noble gas can be recycled by being passed out of the separation vessel 318 through a recycling outlet 320. The contaminants that are solid or liquid can be removed from the separation vessel through a contaminant outlet 322.

After being removed from the separation vessel 318, the recycled noble gas can be passed into a cooling unit 328 configured to receive the noble gas in a supercritical fluid state or gaseous state and to reduce the temperature of the noble gas to a liquid state. The cooling unit 328 can be outfitted with various cooling components such as refrigeration components and fluids that can cool the noble gas to a liquid.

In one option, the cleaning system 300 can include a noble gas storage vessel 324 configured to store the noble gas in a supercritical fluid, gaseous, or liquid state.

The cleaning system 300 can also include a fresh noble gas inlet 326 to receive fresh noble gas into the system. Also, the fresh noble gas inlet 326 can receive other additional substances as described herein. Alternatively, any of the components of the system can include an inlet for receiving a noble gas or additional substance.

The cleaning system 300 can include one or more fluid passageways 330 that connect the components of the cleaning system 300 together so that the noble gas can flow between the different components while in the liquid, gas, or supercritical state. Also, the dashed box around the cleaning system 300 is meant to illustrate that any of the components can be fluidly coupled together with a fluid passageway even if not explicitly shown. For example, the recycling outlet 320 can be directly fluidly coupled with the noble gas storage vessel 324, pressure unit 314, temperature unit 316, supercritical fluid vessel 312, cleaning vessel 302, or others.

The cleaning system 300 can also include one or more valves 332 located at various positions in the system 300 with respect to the different components and fluid passageways 330, such as component inlets and outlets. The valves 323 can regulate the entry or exit of the noble gas to and from the various components, and any component can be outfitted with one or more valves so that fluid flow can be regulated. The dashed box around the cleaning system 300 is also meant to illustrate that any of the components can include one or more valves 332 to regulate fluid flow or even the removal of the contaminants from the separation vessel 318. Additionally, the valves 323 can be associated with a controller that can control the valves 323 to be open or closed as well as what percentage open the valve is when variable. The controller can allow for the operation of the valves to be controlled or programmed as necessary or desired. Also, the dashed box can represent that the controllers of the valves 323 are in communication with a central computing system or controller, and may be operably coupled with a communication network.

The cleaning system 300 can also include one or more pumps 334 located at various positions in the system 300 with respect to the different components and fluid passageways 330. The pumps 334 can pump the noble gas to and from the various components through the fluid passageways 330. The dashed box around the cleaning system 300 is also meant to illustrate that any of the components can include one or more pumps 334 to regulate fluid flow or even the removal of the contaminants from the separation vessel 318.

In one embodiment, the cleaning system 300 can exclude various components or the functionality of multiple components can be combined into a single component. In one instance, the cleaning vessel 302 may be configured to serve the functions provided by the supercritical fluid vessel 312 eliminating the need for a separate supercritical fluid vessel 312. In other instances that the cleaning system 300 includes a supercritical fluid vessel 312, the pressure unit 314 and/or temperature unit 316 can be omitted, or vice versa. Also, the noble gas storage vessel 324 and cooling unit 328 can be omitted.

In one embodiment, the cleaning system 300 can be configured so that the noble gas having contaminant is obtained and removed from the system, and is not recycled in the system. As such, the separation vessel 318, cooling unit 328, and noble gas storage vessel 324 may be omitted. Also, the various fluid passageways 330 may be omitted as the fluids can be transferred between the components manually or by using containers to move the noble gas around the cleaning system 300.

The one or more vessels of the cleaning system 300 can be linked together so that the noble gas in the liquid, gas, or supercritical state can pass through fluid pathways between the different vessels. Also, the different vessels or components can be configured for a particular purpose.

A supercritical fluid vessel 312 can be configured to convert the noble gas to a supercritical fluid. As such, the supercritical fluid vessel 312 can be outfitted with compressors, pressurizers, coolers, and/or heaters that are able to adjust the pressure and temperature to or past the supercritical point. The supercritical fluid vessel 312 can be controlled by a controller (not shown) so that the operation thereof can be controlled and/or monitored.

A pressure unit 314 can be configured to increase pressure of the noble gas to or past the supercritical pressure of the noble gas. The pressure unit 314 can be outfitted with compressors, plunger systems, or other pressurizing components that can increase the pressure of the noble gas to or past the supercritical pressure. The pressure unit 314 can be controlled by a controller (not shown) so that the operation thereof can be controlled and/or monitored.

A temperature unit 316 (e.g., heating unit or cooling unit) can be configured to adjust temperature of the noble gas to or past the supercritical temperature of the noble gas. The temperature unit 316 can be outfitted with heating elements, heating fluids, fluid cycling components, heat exchangers, cooling components, or other components that can be used to increase the temperature of the noble gas to or past the supercritical temperature. The temperature unit 316 can be controlled by a controller (not shown) so that the operation thereof can be controlled and/or monitored.

A cleaning vessel 302 can be configured to receive the noble gas in a supercritical fluid state and to receive an article of manufacture to be cleaned. Alternatively, the cleaning vessel 302 can include components similar to the supercritical fluid vessel 312, pressure unit 314, and temperature unit 316 so that the supercritical state can be achieved, maintain, or modulated in and out of the supercritical fluid state. The cleaning vessel 302 can be configured similarly to any common supercritical chemical reactor or separator. An example of a cleaning vessel can be a HPR-Series High Pressure Chemical Reactor from Supercritical Fluid Technologies. An example cleaning vessel 302 can be characterized as follows: stirred reactor vessel from 50 ml to 800 liter capacity; operate up to 10,000 psi (689 Bar/68.9 MPa/680 atmospheres) and 350° C.; magnetic drive mixing; safety rupture disc assembly; integrated controller with color touch screen; data export via a flash drive communications port; and/or data export via wire, optical, or wireless communication with a data network. The cleaning vessel 302 can be controlled by a controller (not shown) so that the operation thereof can be controlled and/or monitored.

A separation vessel 318 can be configured to receive the noble gas with one or more contaminants from a cleaning vessel. Optionally, the separation vessel 318 can decompress the noble gas to a gaseous state so that the noble gas can be separated from the solid and liquid contaminants. Also, the separation vessel 318 can be operated similar to a distillation column or a chromatography column in the ability to separate the noble gas from the contaminants. The separation vessel 318 can be controlled by a controller (not shown) so that the operation thereof can be controlled and/or monitored.

A noble gas storage vessel 324 can be configured to store the noble gas in a supercritical fluid, gaseous, or liquid state. Any type of storage vessel with adequate strength can be used depending on the state of the noble gas. Common chemical tanks may be appropriate.

A cooling unit 328 can be configured to receive the noble gas in a supercritical fluid state or gaseous state and to reduce the temperature of the noble gas to a liquid state. As such, the cooling unit 328 can be outfitted with cooling components, refrigeration components, refrigeration fluids, cryogenic components, or others. The cooling unit 328 can be controlled by a controller (not shown) so that the operation thereof can be controlled and/or monitored.

The valves 332, pumps 334, or any other components can be controlled by a controller (not shown) so that the operation thereof can be controlled and/or monitored.

In one embodiment, the cleaning system 300 can include a master controller (not shown) that is configured to control and/or monitor the operating conditions and parameters of each of the cleaning system components. The master controller can include a microcontroller to perform all computational, instructional, or data processing functions. The microcontroller and power control components can be located in any module which may reside in association of the cleaning system 300. The master controller can communicate with any of the controllers associated with any of the cleaning system 300 components. Also, the master controller can be configured similar to a standard computer and may include graphical user interfaces (e.g., computer screen or printer), and/or input interfaces (e.g., keyboard, mouse, light pen, voice recognition, touch screens, pushbuttons, knobs, etc.). The master controller can implement: temperature control, agitator speed control, pressure control, over-temperature limit control, valve control, pump control, or other controlling or monitoring functions. The dashed line box around the cleaning system 300 also illustrates that the master controller can communicate with any of the components.

Figure 4:
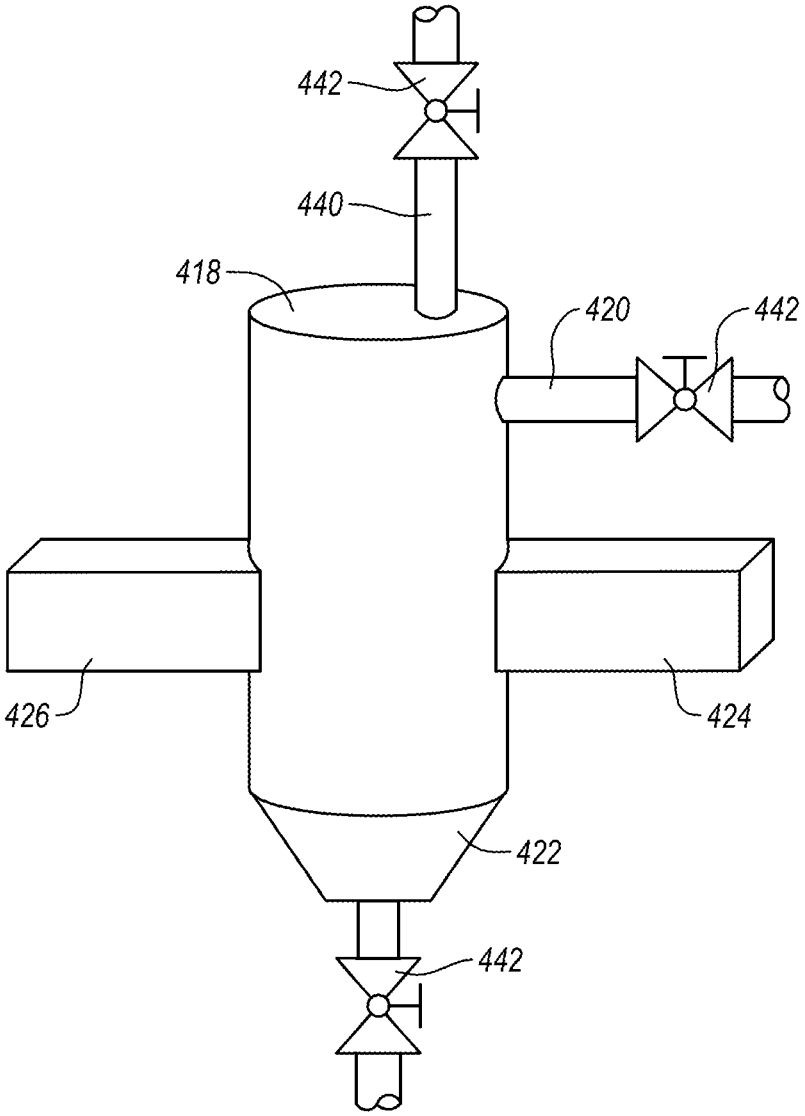
FIG. 4 is a schematic diagram of an illustrative separation vessel.

FIG. 4 shows an embodiment of a separation vessel 418. The separation vessel 418 can receive the noble gas and contaminants from the cleaning vessel 302 as shown in FIG. 3. Also, the separation vessel 418 can have an inlet 440 that is regulated with a valve 442. The separation vessel 418 can include the recycling outlet 420 that is associated with a valve 442 and contaminant outlet. The valve 442 associated with the recycling outlet 420 can function as a decompressor so as to decompress the noble gas to a gaseous state. Also shown are a temperature modulating component 424 (e.g., heater or cooler) and pressure modulating component 426 that can operate to modulate the temperature and pressure in order to facilitate separation of the noble gas from the contaminants. The separation vessel 418 can also include a contaminant outlet 422 that is associated with a valve 442 for removal of the contaminants from the separation vessel 418. The recycling outlet 420 can be configured as a gas outlet that can release the noble gas in the gaseous state from the separation vessel.

The cleaning systems described herein of course can include the noble gas for use in cleaning, whether in the liquid, gas, or supercritical state. Also, the cleaning system can include at least one additional substance, such as a gas, to be combined with the noble gas in the supercritical fluid state for cleaning. Non-limiting examples can include a different noble gas, carbon dioxide, air, oxygen, nitrogen, water, alcohols, methane, ethane, propane, butane, ethylene, propylene, methanol, ethanol, acetone, fragrances, detergents, or combinations thereof to be combined with the noble gas in a cleaning vessel. In one aspect, the additional substance is capable of either being in a supercritical fluid state when the noble gas is in a supercritical fluid state or the substance is absorbable into the noble gas in the supercritical state.

One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

The cleaning systems shown in FIGS. 2-4 can be used in a cleaning process for cleaning an article of manufacture with the supercritical fluid. The cleaning process described herein can be performed similarly to cleaning processes that have used carbon dioxide in its supercritical state. An improvement thereover being that the use of supercritical noble gases are less reactive and can have fewer propensities to damage the article being cleaned. Other advantages of using noble gases are described herein.

In one embodiment, a cleaning process can include converting a noble gas into a supercritical fluid state, and cleaning an article of manufacture with the noble gas in the supercritical fluid state so as to remove one or more contaminants from the article of manufacture. The cleaning can be conducted similar to known solvent and dry cleaning processes with a difference being that the cleaning composition includes a noble gas in its supercritical state. The noble gas can be a major or minor component in the cleaning composition and can range by weight from at least about 10%, at least about 20%, at least about 30%, at least about 40%, at least about 50%, at least about 60%, at least about 70%, at least about 80%, at least about 90%, at least about 99%, or about 100% by weight.

In one embodiment, the cleaning process can include combining one or more additional substances with the noble gas in the supercritical fluid state before or during the cleaning. The mixture can include the additional substances at various ratios with regard to the noble gas as recited herein in weight/weight ratios. Some non-limiting examples of the additional substance can include a different noble gas, carbon dioxide, air, oxygen, nitrogen, ammonia, water, alcohols, methane, ethane, propane, butane, ethylene, propylene, methanol, ethanol, acetone, fragrances, detergents, or combinations thereof as well as others recited herein.

In one embodiment, the additional substance is perchloroethylene and/or siloxane. Alternatively, the additional substance excludes perchloroethylene and/or siloxane.

In one embodiment, the cleaning process can include cycling the pressure of the noble gas in the supercritical fluid state during the cleaning. Such pressure cycling can be done by compression and/or expansion of the cleaning vessel volume, or modulating the pressure by releasing some noble gas to the separation vessel. The pressure cycling can reduce the pressure of the noble gas below the supercritical pressure and/or increases the pressure of the noble gas above the supercritical pressure. For example, the pressure cycling can change the state of the noble gas from a supercritical fluid to a state where at least a part of the noble gas is not in supercritical fluid state. Such pressure cycling can cause nucleation and generation of gas bubbles within the supercritical fluid, and some nucleation can occur by the contaminants being nucleating agents. Also, the bubble generation can function similarly as boiling for dislodging contaminants from the article. Thereby, the nucleation event can facilitate cleaning and removing the contaminant from the article of manufacture.

In one embodiment, the cleaning process can include cycling the temperature of the noble gas in the supercritical fluid state during the cleaning. The temperature cycling can reduce the temperature of the noble gas below the supercritical temperature and/or increases the temperature of the noble gas above the supercritical temperature. The temperature cycling can change the state of the noble gas from a supercritical fluid to a state where at least a part of the noble gas is not in supercritical fluid state. The temperature cycling can also facilitate bubble generation.

In one embodiment, the cleaning process can include generating bubbles in the presence of the article of manufacture while being cleaned or introducing bubbles into the cleaning vessel.

In one embodiment, the cleaning process can include agitating the article of manufacture in a manner that is similar to various cleaning processes that agitate an article to be cleaned in the presence of a cleaning composition. The agitating can be from mechanical agitation with a stirring mechanism, spinning mechanism, or a washing mechanism similar to a traditional washing machine. Also, the agitating can be obtained by bubble generation.

The cleaning process can also include removing the noble gas and one or more contaminants from the article of manufacture. The noble gas and contaminants can be removed in a continual basis where a feed of noble gas containing the contaminants is siphoned from the cleaning vessel during the cleaning process, and whereby noble gas is optionally introduced into the cleaning vessel to maintain the supercritical fluid. For example, the siphoning of the noble gas can facilitate the pressure cycling. Alternatively, the cleaning process can operate on a batch basis where the supercritical noble gas and contaminants are removed after cleaning. In another alternative, the same article can undergo multiple cycles of cleaning with fresh noble gas, which is removed, and then replaced or each cycle.

In one embodiment, the cleaning process can include separating the noble gas from the one or more contaminants after being removed from the cleaning vessel. For example, the separation can be performed in the separation vessel. The separation can include converting the noble gas to a gaseous state to facilitate separating the noble gas from the one or more contaminants, which one or more contaminants are in a solid or liquid state.

In one embodiment, the cleaning process can include recycling the noble gas for additional cleaning cycles of the same or different articles. The recycling process can include cooling the noble gas from a gaseous state to a liquid state after being separated from the one or more contaminants. The liquid noble gas can then be stored in a storage vessel before being used again or converted to a supercritical fluid.

In one embodiment, the cleaning process can include converting the noble gas to a supercritical fluid after being separated from the one or more contaminants. As such, the recycling process can include converting the noble gas to a supercritical fluid before being used again in another cleaning process.

In one embodiment, the recycling process can include separating the noble gas from the additional substance after the cleaning. Such a separation can be performed in the separation vessel described herein, or a dedicated separation vessel can be provided in the cleaning system for separating the noble gas from the additional substances used for cleaning. The separation can be similar to the process for generating noble gases from the environment.

In one embodiment, the cleaning process can include introducing the noble gas in the supercritical fluid state into a cleaning vessel; introducing the article of manufacture into the cleaning vessel; and cleaning the article of manufacture with the noble gas in the supercritical fluid state within the cleaning vessel. Accordingly, the noble gas can be converted into a supercritical fluid before being introduced into the cleaning vessel. Alternatively, the noble gas can be converted to a supercritical fluid within the cleaning vessel. The article usually will be introduced into the cleaning vessel before the noble gas.

In one embodiment, the cleaning process can include increasing the pressure of the noble gas to or past the supercritical pressure of the noble gas before being introduced into the cleaning vessel. Also, the cleaning process can include increasing temperature of the noble gas to or past the supercritical temperature of the noble gas before being introduced into the cleaning vessel.

In one embodiment, the cleaning process can include storing the noble gas in a supercritical fluid, gaseous, or liquid state before or after the cleaning.

The process of cleaning with the noble gases can begin with introduction of a noble gas such as argon. The argon can be compressed at roughly 500 atmospheres to its supercritical form. Compression raises the temperature; possibly to a temperature that is too high for the application and as such the argon can be cooled as necessary. Furthermore, the cooling can allow the argon to be stored for future cleanings if not immediately needed. The fluid argon can be pumped through a controlled temperature element which warms or cools the liquid noble gas to the temperature at which the cleaning is performed.

Cleaning is accomplished in a vessel were the articles to be cleaned are introduced. The waste stream from the cleaned articles can be returned to the separation vessel. The supercritical argon containing dissolved contaminants is bled off in the separator vessel, where the supercritical argon is decompressed to return it to the gaseous state. The contaminants remain in liquid or solid form and are collected out and removed from the separator, while the argon gas is sent through a refrigeration unit to return it to a liquid form for storage to be reused again. Recycling of argon in this closed loop system means only a small portion of the cleaning solution has to be replaced over time due to system leakage. The now clean article of manufacture (e.g., parts or clothes) can be removed from the chamber and are immediately ready for the next step in the manufacturing process or to be worn, since no drying or rinsing is required to remove residual cleaning solution.

In one embodiment, the cleaning process can include preparing a noble gas composition. Noble gases can be separated from the atmosphere and processed into pure or substantially pure noble gases. For example, the noble gas can be prepared by liquefaction of the atmosphere, followed by distillation, and isolation of the noble gases from other components of the atmosphere. The noble gas argon constitutes nearly 1% of the earth's atmosphere, and is plentiful and inexpensive. The other noble gases and mixtures of the noble gases such as krypton and xenon are also useful as cleaners.

In one embodiment, the cleaning process can include preparing a cleaning composition that includes a noble gas and an additional substance. For example, noble gases can be mixed with other gases such as carbon dioxide or nitrogen, or with water, alcohols, fragrances, and/or detergents, as well as any of the additional substances described herein or related substances. The gases are then compressed to their supercritical points where they are useful as cleaning agents (FIG. 1). Supercritical fluids are by definition at a temperature and pressure greater than or equal to the supercritical temperature and pressure of the fluid.

In one embodiment, mixed component supercritical cleaning compositions containing the noble gases can be prepared. For example, a mixture can include argon, carbon dioxide, and isopropanol. By using mixed supercritical fluids, the cleaning solutions can be tailored for the specific substrates being cleaned and contaminants being removed. Furthermore, the use of mixed compositions allows for the tailoring of the pressures and temperatures required to achieve supercritical fluids. Supercritical fluids can be made with carbon dioxide and argon, argon and water, argon-acetone, or others. Table 1 shows the supercritical points from various solvents that can be combined with the noble gases.

TABLE 1

Supercritical properties of various solvents

| Solvent | Molecular weight g/mol | Supercritical temperature K | Supercritical pressure MPa (atm) | Supercritical density g/cm$^3$ |
|---|---|---|---|---|
| Carbon dioxide ($CO_2$) | 44.01 | 304.1 | 7.38 (72.8) | 0.469 |
| Water ($H_2O$) | 18.015 | 647.096 | 22.064 (217.755) | 0.322 |
| Methane ($CH_4$) | 16.04 | 190.4 | 4.60 (45.4) | 0.162 |
| Ethane ($C_2H_6$) | 30.07 | 305.3 | 4.87 (48.1) | 0.203 |
| Propane ($C_3H_8$) | 44.09 | 369.8 | 4.25 (41.9) | 0.217 |
| Ethylene ($C_2H_4$) | 28.05 | 282.4 | 5.04 (49.7) | 0.215 |
| Propylene ($C_3H_6$) | 42.08 | 364.9 | 4.60 (45.4) | 0.232 |
| Methanol ($CH_3OH$) | 32.04 | 512.6 | 8.09 (79.8) | 0.272 |
| Ethanol ($C_2H_5OH$) | 46.07 | 513.9 | 6.14 (60.6) | 0.276 |
| Acetone ($C_3H_6O$) | 58.08 | 508.1 | 4.70 (46.4) | 0.278 |

In one embodiment, the cleaning composition is free of volatile organic compounds so as to be zero-VOC.

There are many advantages to the use of supercritical noble gases, such as for example: being completely non toxic, non-carcinogenic, non-mutagenic, non-reactive, non-combustive; do not harm the ozone layer; do not act as green house gases; being equal to or better than supercritical carbon dioxide in cleaning ability; compression technology easily reaches the critical points of argon, krypton, and xenon; and waste removed from the articles being cleaned is easily separated from the noble gases. Also, a major advantage is that the cleaning can be done without water so that environmental water is not polluted by the cleaning process.

The contaminants can be anything that needs to be cleaned from an article, such as dirt, stains, oils, particles, chemicals, smells, plant particles, animal dander, industrial greases, or others. The contaminants are not limited.

In an illustrative embodiment, any of the systems, operations, processes, etc. described herein can be implemented as computer-readable instructions stored on a computer-readable medium. For example, a computer-readable medium can include computer-executable instructions for performing the cleaning process, operating any of the cleaning system components, obtaining data from any of the cleaning system components, or communicating data to a remote location via a network. The computer-readable instructions can be executed by a processor of a mobile unit, a network element, and/or any other computing device.

There is little distinction left between hardware and software implementations of aspects of systems; the use of hardware or software is generally (but not always, in that, in certain contexts, the choice between hardware and software can become significant) a design choice representing cost vs. efficiency tradeoffs. There are various vehicles by which processes and/or systems and/or other technologies described herein can be effected (e.g., hardware, software, and/or firmware), and that the preferred vehicle will vary with the context in which the processes and/or systems and/or other technologies are deployed. For example, if an implementer determines that speed and accuracy are paramount, the implementer may opt for a mainly hardware and/or firmware vehicle; if flexibility is paramount, the implementer may opt for a mainly software implementation; or, yet again alternatively, the implementer may opt for some combination of hardware, software, and/or firmware.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and/or firmware would be well within the skill of one of skill in the art in light of this disclosure. In addition, those skilled in the art will appreciate that the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a CD, a DVD, a digital tape, a computer memory, etc.; and a transmission type medium such as a digital and/or an analog communication medium (e.g., a fiber optic cable, a waveguide, a wired communications link, a wireless communication link, etc.).

Those skilled in the art will recognize that it is common within the art to describe devices and/or processes in the fashion set forth herein, and thereafter use engineering practices to integrate such described devices and/or processes into data processing systems. That is, at least a portion of the devices and/or processes described herein can be integrated into a data processing system via a reasonable amount of experimentation. Those having skill in the art will recognize that a typical data processing system generally includes one or more of a system unit housing, a video display device, a memory such as volatile and non-volatile memory, processors such as microprocessors and digital signal processors, computational entities such as operating systems, drivers, graphical user interfaces, and applications programs, one or more interaction devices, such as a touch pad or screen, and/or control systems including feedback loops and control motors (e.g., feedback for sensing position and/or velocity; control motors for moving and/or adjusting components and/or quantities). A typical data processing system may be implemented utilizing any suitable commercially available components, such as those typically found in data computing/communication and/or network computing/communication systems.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

All embodiments of the cleaning system, cleaning compositions, or cleaning processes can be used in an interchangeable manner and all embodiments can be used together, as allowable.

The invention claimed is:

1. A textile cleaning composition comprising:

a supercritical fluid having a noble gas as a major component present in an amount of at least 50%; and a fabric softener in the supercritical fluid.

2. The composition of claim 1, further comprising water.

3. The composition of claim 1, the supercritical fluid further comprising one or more substances selected from the group consisting of a second different noble gas, carbon dioxide, air, oxygen, nitrogen, an organic solvent, water, an oxidizing agent, a reducing agent, an aroma compound, a detergent, ammonia, vinegar, a chelator, pH-adjustor, a surfactant, an enzyme, and a bleaching agent.

4. The composition of claim 3, wherein the organic solvent is selected from the group consisting of an alcohol, a phenol, an ester, a hydrocarbon, a halogenated hydrocarbon, a ketone, an aldehyde, acetone, toluene, turpentine, methyl acetate, ethyl acetate, hexane, petrol ether, citrus terpenes, n-pentane, ethylene dichloride, dioxane, dimethyl sulfoxide, acetonitrile, pyridine, acetic acid, dimethyl sulfoxide, acetonitrile, THF, methyl isobutyl ketone, methylene chloride, isooctane, cyclohexane, cyclopentane, carbon disulfide, carbon tetrachloride, o-xylene, benzene, diethylether, chloroform, and combinations thereof.

5. The composition of claim 3, wherein the oxidizing agent is selected from the group consisting of hydrogen peroxide, oxygen, ozone, chlorine, nitric oxide, nitrous oxide, nitrogen dioxide, nitrogen trifluoride, fluorine, chlorine trifluoride, chlorite, chlorate, perchlorate, hypochloride, and combinations thereof.

6. The composition of claim 3, wherein the aroma compound is selected from the group consisting of fragrances, essential oils, perfumes, methyl formate, methyl acetate, methyl butyrate, methyl butanoate, ethyl acetate, ethyl butyrate, ethyl butanoate, isoamyl acetate, pentyl butyrate, pentyl butanoate, pentyl pentanoate, octyl acetate, myrcene, geraniol, nerol, citral, lemonal, citronellal, citronellol, linalool, nerolidol, limonene, camphor, terpineol, alpha-ionone, thujone, benzaldehyde, eugenol, cinnamaldehyde, ethyl maltol, vanillin, anisole, anethole, estragole, thymol, trimethylamine, putrescine, diaminobutane, cadaverine, pyridine, indole, skatole, and combinations thereof.

7. The composition of claim 3, wherein the detergent is selected from the group consisting of soaps, saponins, a foaming surfactant mixture, non-foaming surfactant mixture, anionic surfactants, cationic surfactants, mono-glycerides, di-glycerides, tri-glycerides, and combinations thereof.

8. The composition of claim 3, wherein the bleaching agent is selected from the group consisting of chlorine bleach, sodium hypochlorite, hydrogen peroxide, bleaching peroxide, calcium hypochlorite, peroxide-releasing compound, and combinations thereof.

9. The composition of claim 8, wherein the peroxide-releasing compound is selected from the group consisting of sodium perborate, sodium percarbonate, sodium persulfate, tetrasodium pyrophosphate, urea peroxide, and combinations thereof.

10. The composition of claim 8, further comprising a catalyst to activate the peroxide-releasing agent, wherein the catalyst is selected from tetraacetylethylenediamine and/or sodium nonanoyloxybenzenesulfonate.

11. The composition of claim 3, wherein the pH-adjustor is selected from the group consisting of weak acids, weak bases, bicarbonates, ammonias, phosphates, monosodium phosphate, disodium phosphate, hydrochloric acid, sodium citrate, citric acid, acetic acid, sodium acetate, borax, sodium hydroxide, 3-{[tris(hydroxymethyl)methyl]amino}propanesulfonic acid, N,N-bis(2-hydroxyethyl)glycine, tris(hydroxymethyl)methylamine, N-tris(hydroxymethyl)methylglycine, 4-2-hydroxyethyl-1-piperazineethanesulfonic acid, and combinations thereof.

12. The composition of claim 1, wherein the fabric softener is selected from the group consisting of soap water emulsion, olive oil water emulsion, corn oil water emulsion, tallow oil water emulsion, quaternary ammonium salts with one or more long alkyl chains, silicone-based compound, polydimethylsiloxane, antistatic agents, salts of mono or di esters of phosphoric acid, and combinations thereof.

13. The composition of claim 3, wherein the surfactant is selected from the group consisting of perfluorooctanoate, sodium dodecyl sulfate, sodium laureth sulfate, alkyl benzene sulfonate, cetyl trimethylammonium bromide, benzalkonium chloride, dodecyl betaine, cocamidopropyl betaine, alkyl poly(ethylene oxide), octyl glucoside, cetyl alcohol, polysorbates, and combinations thereof.

14. The composition of claim 1, wherein the supercritical fluid is substantially devoid of an abrasive, carbon dioxide, a detergent, a siloxane, a hydrocarbon, perchloroethylene, tetrachloroethylene, and a volatile organic compound.

15. The composition of claim 1, further comprising bubbles in the supercritical fluid.

16. The composition of claim 1, further comprising a plurality of abrasive particles selected from the group consisting of calcite, emery, diamond, novaculite, pumice dust, rouge, sand, zirconia alumina, borazon, ceramic, ceramic aluminum oxide, ceramic iron oxide, aluminum oxide, glass powder, steel abrasive, silicon carbide, and combinations thereof.

17. The composition of claim 1, further comprising an enzyme capable of digesting one or more of proteins, fats, or carbohydrates.

18. The composition of claim 1, the supercritical fluid being devoid of carbon dioxide, an organic solvent, water, an oxidizing agent, a reducing agent, an aroma compound, a detergent, ammonia, vinegar, a chelator, pH-adjustor, a surfactant, an enzyme, and a bleaching agent.

19. The composition of claim 1, the supercritical fluid having a noble gas as a major component present in an amount of at least 70%.

20. The composition of claim 1, wherein the supercritical fluid having a noble gas as a major component present in an amount of at least 90%.

* * * * *